US011484808B2

(12) United States Patent
Moore et al.

(10) Patent No.: US 11,484,808 B2
(45) Date of Patent: Nov. 1, 2022

(54) INFLATABLE ORNAMENT APPARATUS

(71) Applicants: Kristy Moore, Friendswood, TX (US); Jennifer Leigh Couch, Houston, TX (US); Amberly Hall, Houston, TX (US)

(72) Inventors: Kristy Moore, Friendswood, TX (US); Jennifer Leigh Couch, Houston, TX (US); Amberly Hall, Houston, TX (US)

(73) Assignee: HOLIBALL INC.

( * ) Notice: Subject to any disclaimer, the term of this patent is extended or adjusted under 35 U.S.C. 154(b) by 105 days.

(21) Appl. No.: 17/187,072

(22) Filed: Feb. 26, 2021

(65) Prior Publication Data

US 2021/0283520 A1 Sep. 16, 2021

Related U.S. Application Data

(60) Provisional application No. 62/989,225, filed on Mar. 13, 2020.

(51) Int. Cl.

| | |
|---|---|
| ***F21V 3/02*** | (2006.01) |
| ***A63H 27/10*** | (2006.01) |
| *F21Y 115/10* | (2016.01) |

(52) U.S. Cl.

CPC ..... *A63H 27/10* (2013.01); *F21V 3/023* (2013.01); *A63H 2027/1058* (2013.01); *A63H 2027/1075* (2013.01); *F21Y 2115/10* (2016.08)

(58) Field of Classification Search

CPC ..... F21V 3/023

See application file for complete search history.

(56) References Cited

U.S. PATENT DOCUMENTS

| | | | | |
|---|---|---|---|---|
| 4,934,986 A * | 6/1990 | Wallace | A63H 27/10 446/222 |
| 11,287,103 B2 * | 3/2022 | Palumbo | F21V 3/026 |

* cited by examiner

*Primary Examiner* — Vip Patel

(57) ABSTRACT

The invention is an inflatable globe having a generally round shape and circumference of between 2 feet and 10 feet. An attachment pin, plug or other closure mechanism are coupled to the top of the inflatable globe. A topper is configured to fit over the attachment pin, plug or other closure mechanism. A hanger is threaded through the attachment pin, plug or closure mechanism and then through the topper. An electric light coupled to the plug is suspended inside the globe. The inflatable globe is made of a resilient polymer material and can be monochromatic or comprise a plurality of colors.

15 Claims, 6 Drawing Sheets

INFLATABLE ORNAMENT APPARATUS

CROSS REFERENCE TO RELATED APPLICATION

This application claims the benefit of U.S. Provisional Application No. 62/989,225, filed Mar. 13, 2020, the contents of which are incorporated herein.

TECHNICAL FIELD

The present invention relates to holiday ornaments.

BACKGROUND OF THE INVENTION

Holiday ornaments, baubles, "Christmas bulbs" or "Christmas bubbles" or "Christmas balls" are decorations that are usually made of blown glass, metal, wood, blown plastics, expanded polystyrene or ceramics and are typically used to decorate a Christmas tree. Ornaments take many different forms, from a simple round ball to highly artistic designs. Ornaments are almost always reused year after year rather than purchased annually, and family collections often contain a combination of commercially produced ornaments and decorations created by family members. Such collections are often passed on and augmented from generation to generation.

Such holiday ornaments are small in size, having circumference of between 2 inches and 5 inches. What is desired is a much larger ornament made of a resilient material that is capable of being deployed in the outdoors in yards or on live trees, and which can be internally illuminated. The invention comprises such an ornament.

SUMMARY OF THE INVENTION

The invention is an inflatable, resilient, plastic polymer globe with a plastic-coated topper and hanger for use as a holiday decoration. The invention can be deflated to allow efficient storage. The invention has several components including the inflatable globe with attachment pin, light source, closure mechanism, topper and hanger. While the invention is directed for use as a Christmas ornament, it can be used without the topper for other occasions.

To those skilled in the art to which this invention relates, many changes in construction and widely differing embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the present invention including the features, advantages and specific embodiments, reference is made to the following detailed description along with accompanying Figures, in which.

DETAILED DESCRIPTION

Figure 1:
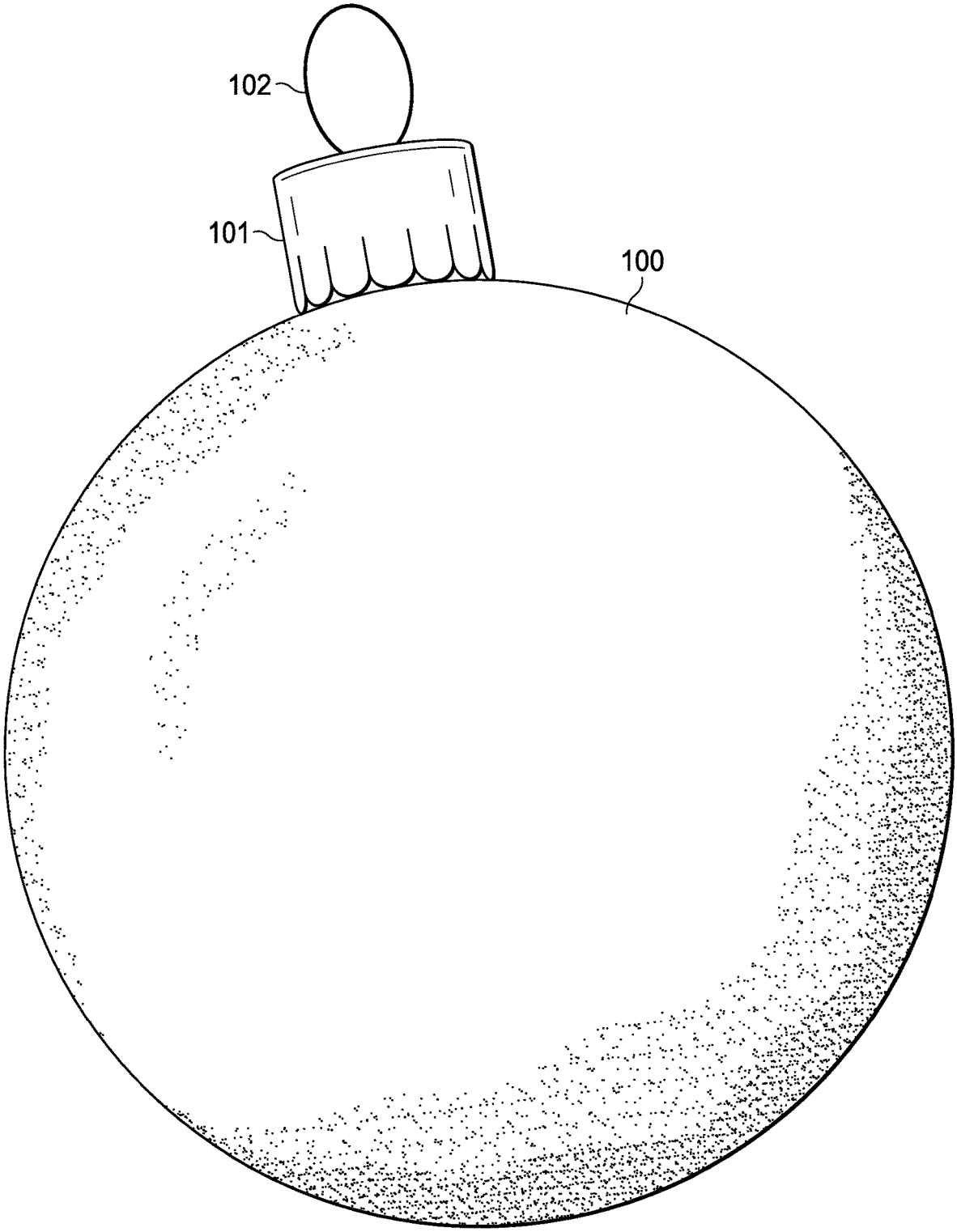
FIG. 1 is a side-view of the assembled invention in an embodiment.

While the making and using of the disclosed embodiments of the present invention is discussed in detail below, it should be appreciated that the present invention provides many applicable inventive concepts which can be embodied in a wide variety of specific contexts. Some features of the preferred embodiments shown and discussed may be simplified or exaggerated for illustrating the principles of the invention.

The invention is an inflatable, resilient, plastic polymer globe for use as a holiday decoration. More specifically, the invention is a holiday apparatus, comprising an inflatable globe having a generally round shape and circumference of between 2 feet and 10 feet with an opening allowing ingress into the interior of the globe. A closure mechanism securely couples to opening into the inflatable globe thus restricting the egress of air from the inflatable globe. A topper is configured to fit over the closure mechanism and a hanger is configured to be threaded through the closure mechanism. Without limiting the materials used to make the invention in an embodiment, the inflatable globe is made of a resilient polymer material and the topper is made of a molded plastic material. The topper comprises a cylindrical shape having a substantially closed upper surface with an orifice therethrough for accepting the closure mechanism and hanger and a side extending down from the upper surface. Further, the topper has a finish that is selected from the group consisting or electroplated and painted. The opening into the inflatable globe can be a threaded attachment pin having a cylindrical orifice being a conduit into the interior of the globe. The closure mechanism couples to the attachment pin at the top of the inflatable globe. Alternatively, the opening is a inwardly cylindrical portion of the inflatable globe that extends into the interior of the inflatable globe and the closure mechanism is a plug that is received into the opening. A light source can be located at an end of said plug, said light source being a compact electric light source such as a Light-Emitting Diode and powered by one from the group consisting of an internal battery, external battery unit and solar panel via wires extending through said attachment pin and topper. Further, the closure mechanism can comprise a threaded portion configured to be coupled to the integrated attachment pin. The hanger can be made from one selected from the group consisting of steel, plastic, string, and cord. The inflatable globe can be red or green or other color and can be monochromatic or having a pattern of a plurality of colors.

The invention further comprises an inflatable globe having a generally round shape and circumference of between 2 feet and 10 feet and an opening into the interior of the globe located at the top of said inflatable globe. A removable ribbed plug is configured to be received into the opening in the top of said globe having a conical flared stopper near its midpoint, and a through-hole at its upper end and is operable to maintain air pressure in said inflatable globe when inserted. Further, a topper is configured to fit over the removable threaded attachment pin and a hanger is threaded through the through-hole at the upper end of said removable attachment pin.

This embodiment of the invention further comprises a light source at an end of said removable ribbed plug, said light source being a compact electric light source such as a Light-Emitting Diode and wherein said light source is powered by one from the group consisting of an internal battery, external battery unit and solar panel via wires extending through said attachment pin and topper. A further embodiment of the invention is an inflatable holiday apparatus, comprising an inflatable globe with an attachment pin, said attachment pin extending a short distance through a threaded or ridged opening on the top of said inflatable globe such that one end of said attachment pin defined as the interior end is inside said globe when assembled, said attachment pin comprising a threaded section corresponding to said threaded or ridged opening on the top of said inflatable globe. Said embodiment further includes a topper, a hanger, and a light source at said interior end of said attachment pin, said light source being a compact electric light source such as a Light-Emitting Diode wherein said light source is powered by one from the group consisting of an internal battery, external battery unit and solar panel via wires extending through said attachment pin and topper.

Figure 2:
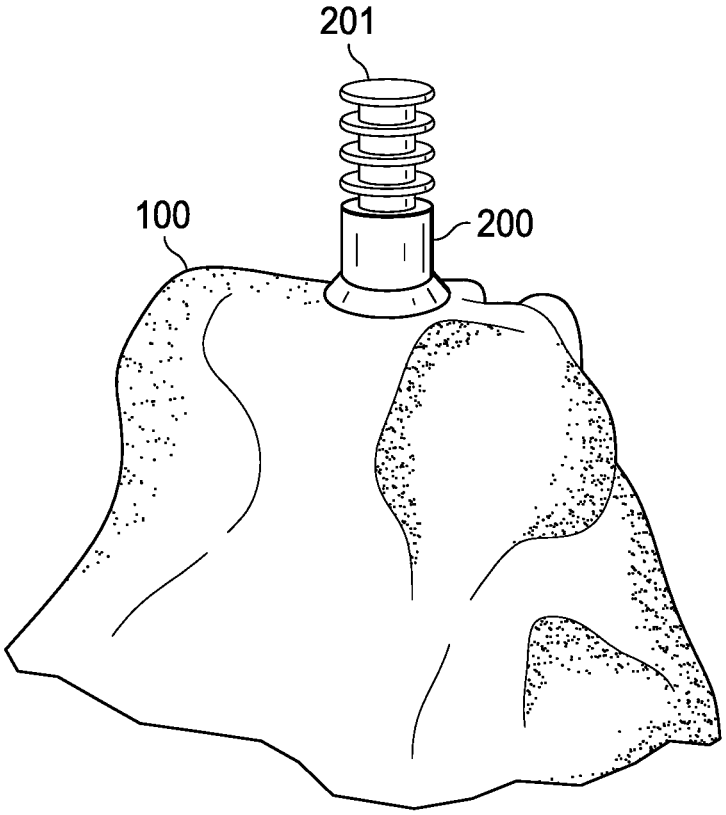
FIG. 2 is a close view of the globe component in a deflated state in an embodiment of the invention.
Figure 3:
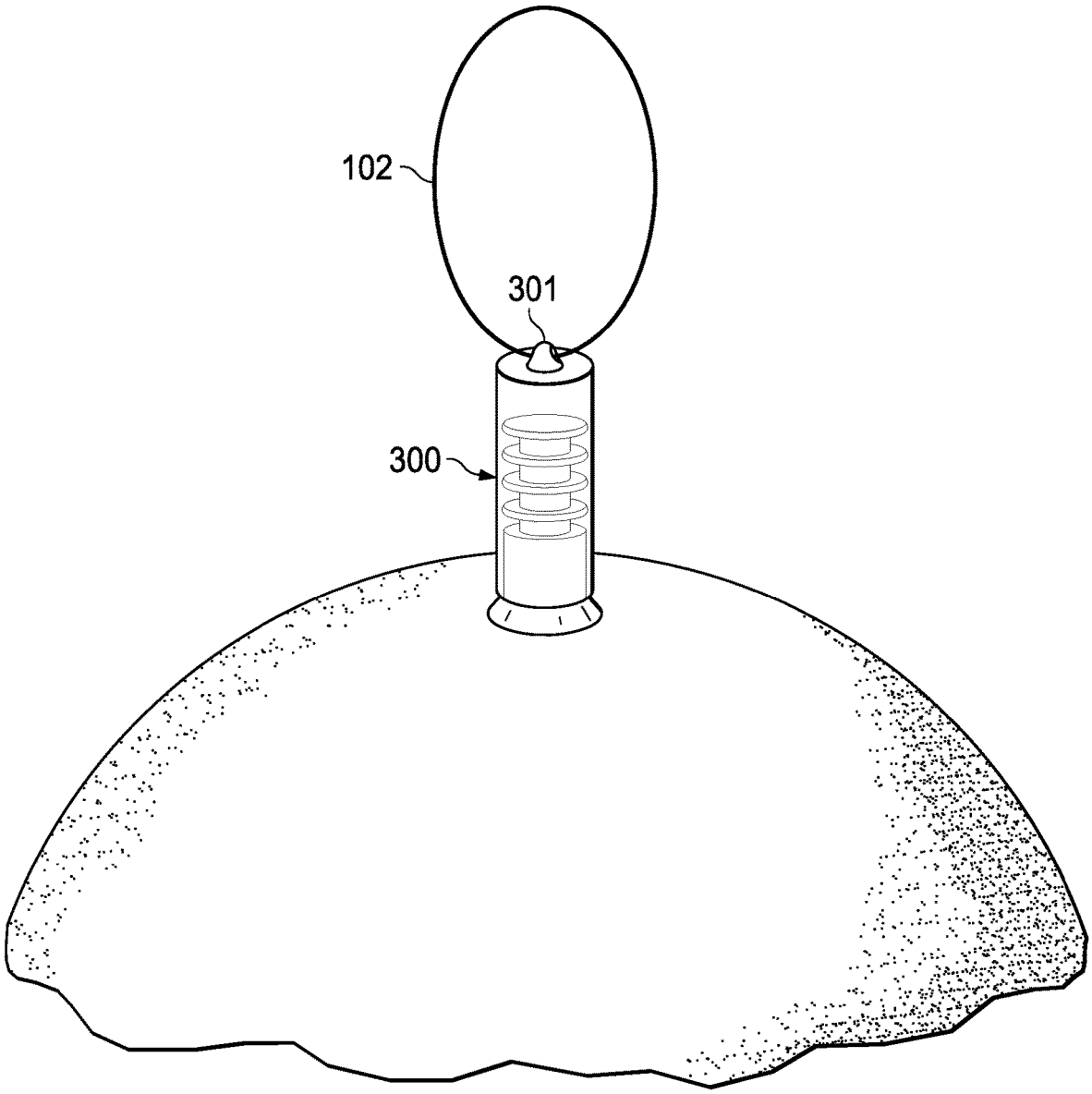
FIG. 3 is a close view of the assembled inflated globe, closure mechanism, and hanger components in an embodiment of the invention.
Figure 4:
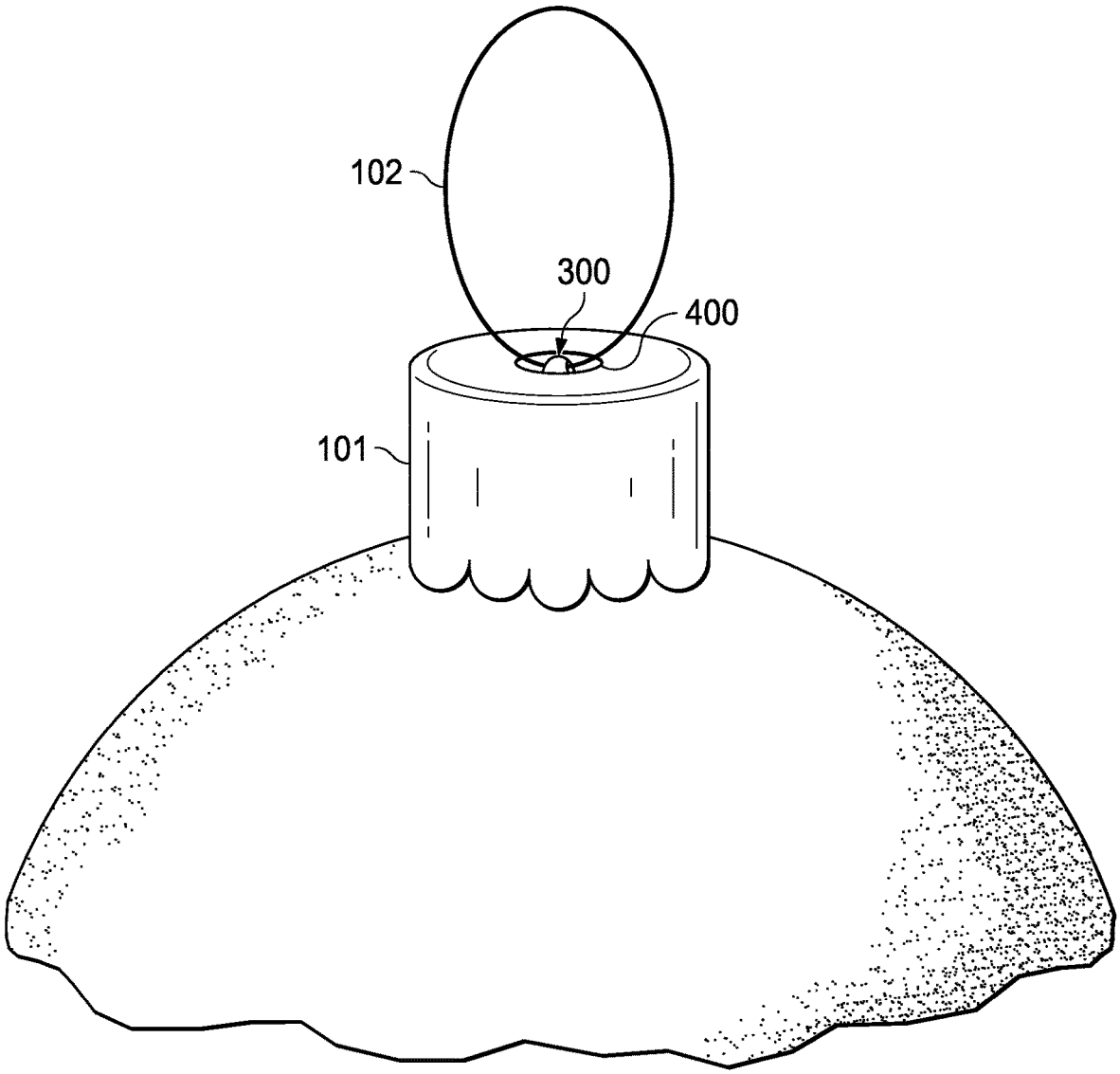
FIG. 4 is a close view of the assembled inflated globe, hanger, and topper components in an embodiment of the invention.

Now referring to the Figures, in an embodiment the invention has several components. As seen in FIG. 1, these include an inflatable globe 100 having a topper 101 and hanger 102. Closure mechanism 300 (seen in FIG. 3) is located under topper 101. FIG. 2 shows deflated inflatable globe 100, integrated attachment pin 200, and external threaded or ridged section 201. Referring to FIG. 3, said closure mechanism 300 comprises a hollow cylinder having at its upper end an endcap and extended loop opening 301, and having an internal threaded or ridged section extending inward from its interior surface, said threaded or ridged section corresponding to an external threaded or ridged section 201 on the outer surface of said integrated attachment pin 200. Following inflation of inflatable globe 100, closure mechanism 300 is fitted to attachment pin 200 such that air pressure is maintained inside said globe. Referring to FIG. 4, hanger 102 is looped through opening 301 at the upper end of the closure mechanism 300. Said hanger 102 is then compressed by a user such that it presents a smaller diameter and inserted through an opening 400 in the upper surface of topper 101, topper 101 then being lowered on to the closure mechanism 300. Said hanger 102 can be made of steel, plastic, string, cord or similar material.

Figure 5A:
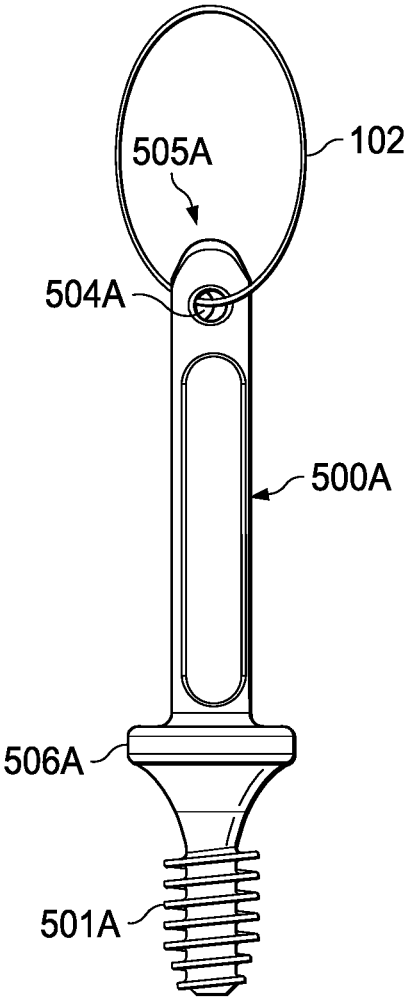
FIGS. 5A and 5B are side views of the pin and plug components used with embodiments of the invention.
Figure 5B:
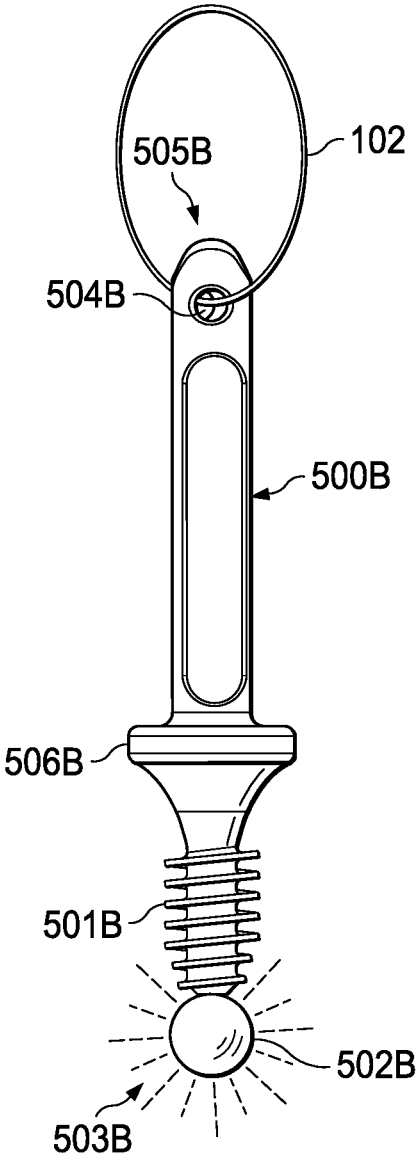
Figure 6:
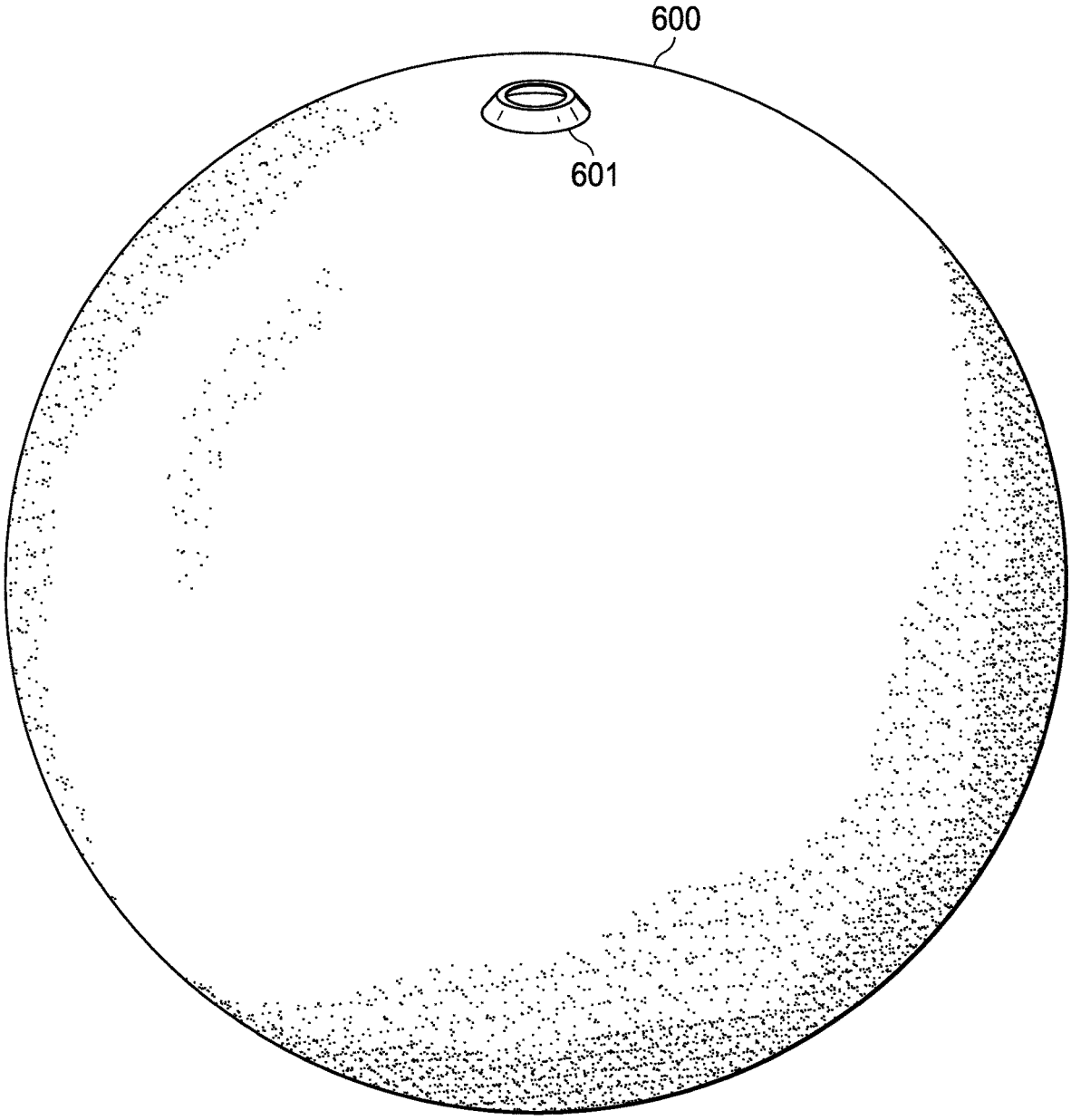
FIG. 6 is a close view of the globe component of the further embodiment of the invention.

In another embodiment, referring to FIGS. 5A, 5B and 6, the components of the invention include an inflatable globe 600, topper, hanger 102, and plug 500A, 500B, said plug 500A, 500B extending a short distance through a threaded or ridged opening 601 on the top of said inflatable globe 600 such that one end of said plug 500A, 500B defined as the interior end is inside said globe when assembled, said plug comprising a threaded or ribbed section 501A, 501B corresponding to said threaded or ridged opening 601 on the top of said globe and operable to retain air inside the inflatable globe. As seen in FIG. 5B, and a light source 502B at said interior end 503B of said plug 500B, said light source 502B being a compact electric light source such as a Light-Emitting Diode; said light source is powered by an internal battery, external battery unit or solar panel via wires extending through said plug and topper. The hanger 102 is looped through an opening 505A, 505B located at the exterior end 505A, 505B of plug 500A, 500B, said exterior end 505A, 505B being outside said inflatable globe when invention is assembled. In this embodiment, plug 500A, 500B further comprises at its midpoint a flared conical stopper 506A, 506B to maintain air pressure in said inflatable globe when said plug 500A, 500B is inserted.

An advantage of the invention is that it can be inflated to a circumference of several feet or meters and then be deflated after use to allow for efficient storage. The invention includes an ultraviolet (UV) resistant coating, and is durable for use in any weather condition.

The invention is preferably inflated with an electric fast flow inflator. In an embodiment, referring to FIGS. 2 through 4, once globe 100 is at its desired size, the attachment pin 200 on the globe 100 is plugged with the closure mechanism 300. The hanger 102 is coupled to the closure mechanism 300. The topper 101 is placed over the closure mechanism 300. The inflated ornament can then be hung to a tree or tethered to the ground.

In a further embodiment, referring to FIGS. 5 and 6 once globe 600 is at its desired size, the plug 500A, 500B is inserted through opening 601 in globe 600. The hanger 102 is coupled to the plug 500A, 500B. The topper is placed over the hanger and plug. In a further embodiment, a light source such as a light emitting diode can be positioned at the end of the plug and powered by an internal or external power source. The inflated ornament can then be illuminated and hung to a tree or tethered to the ground. The illumination is further adapted to be controlled by a local switch or timer. Illumination can also be controlled by a remote device such as a standalone unit or smartphone running a dedicated application, control signals being sent to electronics integrated into said attachment pin or topper by wireless means such as 2.4 GHz radio or Bluetooth™, said integrated electronics including a receiving antenna, non-volatile memory, and processor capable of running a program in the form of instructions stored in said memory.

The topper is comprised of a resilient material such as molded plastic and is electroplated or painted with a shiny finish to suggest the appearance of a glass ornament. While the invention is directed for use as a Christmas ornament, it can be used without the topper for other occasions.

More generally, the invention is a holiday apparatus comprising an inflatable globe having a generally round shape and circumference of between 1 foot and 20 feet. When plugged, the globe is impervious to release of air that is injected therein prior to plugging. An attachment pin is attached or coupled to the top of the globe for accepting a closure mechanism. A topper is configured to fit over the closure mechanism. A hanger is threaded through an orifice at the end of the closure mechanism and through an opening or orifice in the top surface of the topper.

The inflatable globe is preferably made of a resilient polymer material. The topper is preferably made of a molded plastic material and comprises a cylindrical shape having a substantially closed upper surface with an orifice therethrough for accepting the attachment pin, closure mechanism and hanger and a cylindrical side wall extending down from the upper surface. In an embodiment, the side wall of the topper has decorative notches cut into the side thereof. The topper is electroplated or painted or can be molded into its final color. The closure mechanism is preferably a threaded plug but also can be any suitable mechanism configured to keep injected air from escaping from the globe. The hanger that is threaded through the plug is made from a material selected from the group consisting of steel, plastic, string, cord or similar material. The globe is monochromatic or can be comprised of a plurality of colors.

In an embodiment the inflatable ball further comprises an electronic light such as an LED suspended therein, said light being powered by a replaceable or rechargeable battery, or solar panel or other external power source. In an embodiment, said light is coupled to a switch and can be set to on or off. In another embodiment, said light is coupled via a wireless receiver to a remote control and can be set to on or off using said remote. In a further embodiment, the inflatable ball comprises multiple lights such as LEDs suspended therein, said lights emitting different or varied colors, and the desired emitted light color can be controlled via said switch or remote by mixing the intensity of the individual lights.

The embodiments shown and described above are only exemplary. Even though numerous characteristics and advantages of the invention have been set forth in the foregoing description, the disclosure is illustrative only and changes may be made within the principles of the invention to the full extent indicated by the broad general meaning of the terms used herein. Various alterations, modifications and substitutions can be made to the disclosed invention without departing in any way from the spirit and scope of the invention.

The invention claimed is:

1. A holiday apparatus, comprising an inflatable globe having a generally round shape and circumference of between 2 feet and 10 feet;

an opening allowing ingress into the interior of the globe;

a closure mechanism that securely couples to opening into the inflatable globe thus restricting the egress of air from the inflatable globe;

a topper configured to fit over the closure mechanism; and a hanger adapted to be threaded through the closure mechanism.

2. The holiday apparatus of claim 1, wherein the inflatable globe is made of a resilient polymer material.

3. The holiday apparatus of claim 1, wherein the topper is made of a molded plastic material.

4. The holiday apparatus of claim 3, wherein the topper comprises a cylindrical shape having a substantially closed upper surface with an orifice therethrough for accepting the closure mechanism and hanger and a side extending down from the upper surface.

5. The holiday apparatus of claim 3, wherein the topper has a finish that is selected from the group consisting or electroplated and painted.

6. The holiday apparatus of claim 1 wherein the opening is a threaded attachment pin having a cylindrical orifice being a conduit into the interior of the globe and the closure mechanism couples to the attachment pin at the top of the inflatable globe.

7. The holiday apparatus of claim 1 wherein the opening is a inwardly cylindrical portion of the inflatable globe that extends into the interior of the inflatable globe and the closure mechanism is a plug that is received into the opening.

8. The holiday apparatus of claim 7, further comprising a light source at an end of said plug, said light source being a compact electric light source such as a Light-Emitting Diode.

9. The holiday apparatus of claim 8, wherein said light source is powered by one from the group consisting of an internal battery, external battery unit and solar panel via wires extending through said attachment pin and topper.

10. The holiday apparatus of claim 6, wherein the closure mechanism is threaded and configured to be coupled to the integrated attachment pin.

11. The holiday apparatus of claim 1, wherein the hanger is made from one selected from the group consisting of steel, plastic, string, and cord.

12. The holiday apparatus of claim 1, wherein the globe is one selected from the group consisting of monochromatic or having a pattern of a plurality of colors.

13. A holiday apparatus, comprising an inflatable globe having a generally round shape and circumference of between 2 feet and 10 feet and an opening into the interior of the globe located at the top of said inflatable globe;

a removable ribbed plug that is received into the opening in the top of said globe having a conical flared stopper near its midpoint, and a through-hole at its upper end and is operable to maintain air pressure in said inflatable globe when inserted;

a topper configured to fit over the removable threaded attachment pin; and a hanger to be threaded through the through-hole at the upper end of said removable attachment pin.

14. The holiday apparatus of claim 13, further comprising a light source at an end of said removable ribbed plug, said light source being a compact electric light source such as a Light-Emitting Diode and wherein said light source is powered by one from the group consisting of an internal battery, external battery unit and solar panel via wires extending through said attachment pin and topper.

15. An inflatable holiday apparatus, comprising:

an inflatable globe;

an attachment pin, said attachment pin extending a short distance through a threaded or ridged opening on the top of said inflatable globe such that one end of said attachment pin defined as the interior end is inside said globe when assembled, said attachment pin comprising a threaded section corresponding to said threaded or ridged opening on the top of said inflatable globe;

a topper;

a hanger, and a light source at said interior end of said attachment pin, said light source being a compact electric light source such as a Light-Emitting Diode wherein said light source is powered by one from the group consisting of an internal battery, external battery unit and solar panel via wires extending through said attachment pin and topper.

* * * * *